US011371240B1

(12) United States Patent
Foral et al.

(10) Patent No.: US 11,371,240 B1
(45) Date of Patent: Jun. 28, 2022

(54) INSULATION RETAINER CLIP

(71) Applicants: Joseph J. Foral, Blair, NE (US); Rene Barrera, Bennington, NE (US)

(72) Inventors: Joseph J. Foral, Blair, NE (US); Rene Barrera, Bennington, NE (US)

( * ) Notice: Subject to any disclaimer, the term of this patent is extended or adjusted under 35 U.S.C. 154(b) by 0 days.

(21) Appl. No.: 17/069,190

(22) Filed: Oct. 13, 2020

(51) Int. Cl.
*F16B 2/24* (2006.01)
*E04B 1/74* (2006.01)
*E04B 2/72* (2006.01)

(52) U.S. Cl.
CPC ..... *E04B 1/74* (2013.01); *E04B 2/721* (2013.01)

(58) Field of Classification Search
CPC ..... E04B 1/74; E04B 1/721; E04F 13/081; E04F 13/0803; E04F 13/0805
USPC ..... 52/404.1, 404.2, 404.3, 404.4, 506.05, 52/511, 512, 579
See application file for complete search history.

(56) References Cited

U.S. PATENT DOCUMENTS 4,011,700 A * 3/1977 Sado ..... E06B 9/04 52/235
4,104,837 A * 8/1978 Naito ..... B62D 27/06 52/239
4,107,887 A * 8/1978 Wendt ..... E04B 1/86 52/105
4,637,190 A * 1/1987 Minialoff ..... E04C 2/292 52/579
4,642,961 A * 2/1987 Cruise ..... E04D 13/1618 52/404.2
4,715,156 A * 12/1987 Dozzo ..... E04D 13/1625 52/404.3
4,835,928 A * 6/1989 Scott ..... E04B 1/4178 52/426
5,440,854 A * 8/1995 Hohmann ..... E04B 1/4178 52/379
5,634,310 A * 6/1997 Hohmann ..... E04B 1/4178 52/407.4
5,848,512 A * 12/1998 Conn ..... E04C 3/36 52/837
6,098,364 A * 8/2000 Liu ..... E04F 13/0855 52/235
6,131,360 A * 10/2000 Dalen ..... E04B 1/4178 52/379
6,158,915 A * 12/2000 Kise ..... E04D 13/1606 403/2
6,170,214 B1 * 1/2001 Treister ..... E04F 13/0808 52/235
6,374,561 B1 * 4/2002 Ishiko ..... E04F 13/0814 52/366
7,424,793 B1 * 9/2008 Shriver ..... E04B 2/88 52/235
8,297,019 B2 * 10/2012 Lorenz ..... E04F 13/0805 52/511
8,365,481 B2 * 2/2013 Scully ..... E04F 13/0805 52/235

(Continued)

*Primary Examiner* — Brian E Glessner
*Assistant Examiner* — James J Buckle, Jr.
(74) *Attorney, Agent, or Firm* — Suiter Swantz pc llo

(57) ABSTRACT

An insulation clip which is used to retain insulation in place before materials are placed over the insulation during the construction of a wall assembly. The clip is configured to be snapped onto either a horizontally disposed girt or a vertically disposed girt. The clip not only maintains the insulation in place but creates a gap between the outer side of the insulation and the cladding which is placed thereon.

5 Claims, 8 Drawing Sheets

(56) References Cited

U.S. PATENT DOCUMENTS

| | | | | |
|---|---|---|---|---|
| 8,387,324 | B2 * | 3/2013 | Holm | E04F 13/0807 52/506.06 |
| 8,516,763 | B2 * | 8/2013 | Hohmann, Jr. | E04B 1/4178 52/506.05 |
| 8,555,596 | B2 * | 10/2013 | Hohmann, Jr. | E04B 1/4178 52/712 |
| 8,769,901 | B2 * | 7/2014 | Todd | E04F 13/0817 52/483.1 |
| 8,863,459 | B2 * | 10/2014 | Holt | E04F 13/0803 52/509 |
| 9,010,064 | B1 * | 4/2015 | Farahmandpour | E04B 1/4185 52/714 |
| 9,447,584 | B2 * | 9/2016 | Farahmandpour | E04F 13/0853 |
| 9,493,941 | B2 * | 11/2016 | White | F25D 23/085 |
| 9,631,373 | B2 * | 4/2017 | Loyd | E04B 2/90 |
| 10,119,267 | B2 * | 11/2018 | Petzold | E04F 13/0832 |
| 10,233,636 | B2 * | 3/2019 | Kennedy | E04B 2/28 |
| 10,612,574 | B1 | 4/2020 | Foral et al. | |
| 2007/0227086 | A1 * | 10/2007 | Beavers | E04B 1/80 52/309.7 |
| 2013/0152498 | A1 * | 6/2013 | Krause | E04F 13/0817 52/235 |
| 2014/0026510 | A1 * | 1/2014 | Kubassek | E04B 1/40 52/512 |

* cited by examiner

INSULATION RETAINER CLIP

BACKGROUND OF THE INVENTION

Field of the Invention

This invention relates to a clip which is used to retain insulation in place during the construction of a wall. Even more particularly, this invention relates to a clip which is used to retain insulation in place before materials are placed over the insulation. Even more particularly, this invention relates to a clip which is snapped onto a girt to retain insulation in place. Still more particularly, this invention relates to a clip which creates a gap between the insulation and the cladding which is placed on the exterior of the wall. Further, the clip of this invention may be used with horizontally disposed girts or vertically disposed girts.

Description of the Related Art

During the construction of a wall, vertically disposed and horizontally spaced-apart studs are secured to a bottom plate and a top plate and extend therebetween. Sheathing is secured to the outer side of the studs and a weather barrier is placed over the exterior of the sheathing. Elongated and horizontally disposed girts are then secured to the sheathing and studs in a vertically spaced-apart manner. Insulation is then positioned between the girts. The problem arises as to how to retain the insulation in place in the girts until exterior cladding is placed on the exterior of the wall. Applicants' U.S. Pat. No. 10,612,574 B1 solved the problems of the prior art by providing a retainer clip which holds the insulation in place until materials are placed over the insulation. However, to the best of Applicants' knowledge, no one has provided an insulation retainer clip which creates a gap between the insulation and the cladding which is placed on the exterior of the wall to provide a water drainage channel or gap therebetween.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A clip is provided for retaining insulation in place on a wall under construction before other materials are positioned outwardly of the insulation. The clip of this invention is snapped onto a girt to not only retain the insulation in place but to also create a channel or gap between the insulation and the exterior cladding.

The clip of this invention includes a vertically disposed outer wall having an upper end, a lower end, a first side, a second side, an outer side and an inner side. A horizontally disposed first wall, having inner and outer ends, extends horizontally inwardly from the upper end of the outer wall, A vertically disposed second wall, having upper and lower ends, extends downwardly from the inner end of the first wall thereby creating a first slot between the outer wall and the second wall. A horizontally disposed third wall, having inner and outer ends, extends inwardly from the lower end of the second wall. A vertically disposed fourth wall, having upper and lower ends, extends upwardly from the inner end of the third wall. The second wall and the fourth wall define a second slot therebetween.

A horizontally disposed fifth wall, having inner and outer ends, extending horizontally inwardly from the lower end of the outer wall. A vertically disposed sixth wall, having upper and lower ends, extends upwardly from the inner end of the fifth wall. The outer wall and the sixth wall define a third slot therebetween. A horizontally disposed seventh wall, having inner and outer ends, extends horizontally inwardly from the upper end of the sixth wall. A vertically disposed eighth wall, having upper and lower ends, extends downwardly from the inner end of the seventh wall. The sixth and eighth walls are spaced-apart to define a fourth slot therebetween. The third and seventh walls are spaced-apart to define a fifth slot therebetween. The orientation of the clip described above will be used with horizontally disposed girts. When the clip is going to be used with vertically disposed girts, the clip is rotated 90 degrees prior to being snapped onto a vertically disposed girt.

A principal object of the invention is to provide a clip for retaining insulation in place before other materials are positioned on the outer sides of the insulation.

A further object of the invention is to provide a clip of the type described which is snapped onto a girt to not only retain the insulation in place but to also provide a channel or gap between the insulation and the exterior cladding of the wall.

Yet another object of the invention is to provide a clip of the type described which does not interfere with the installation of cladding materials.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
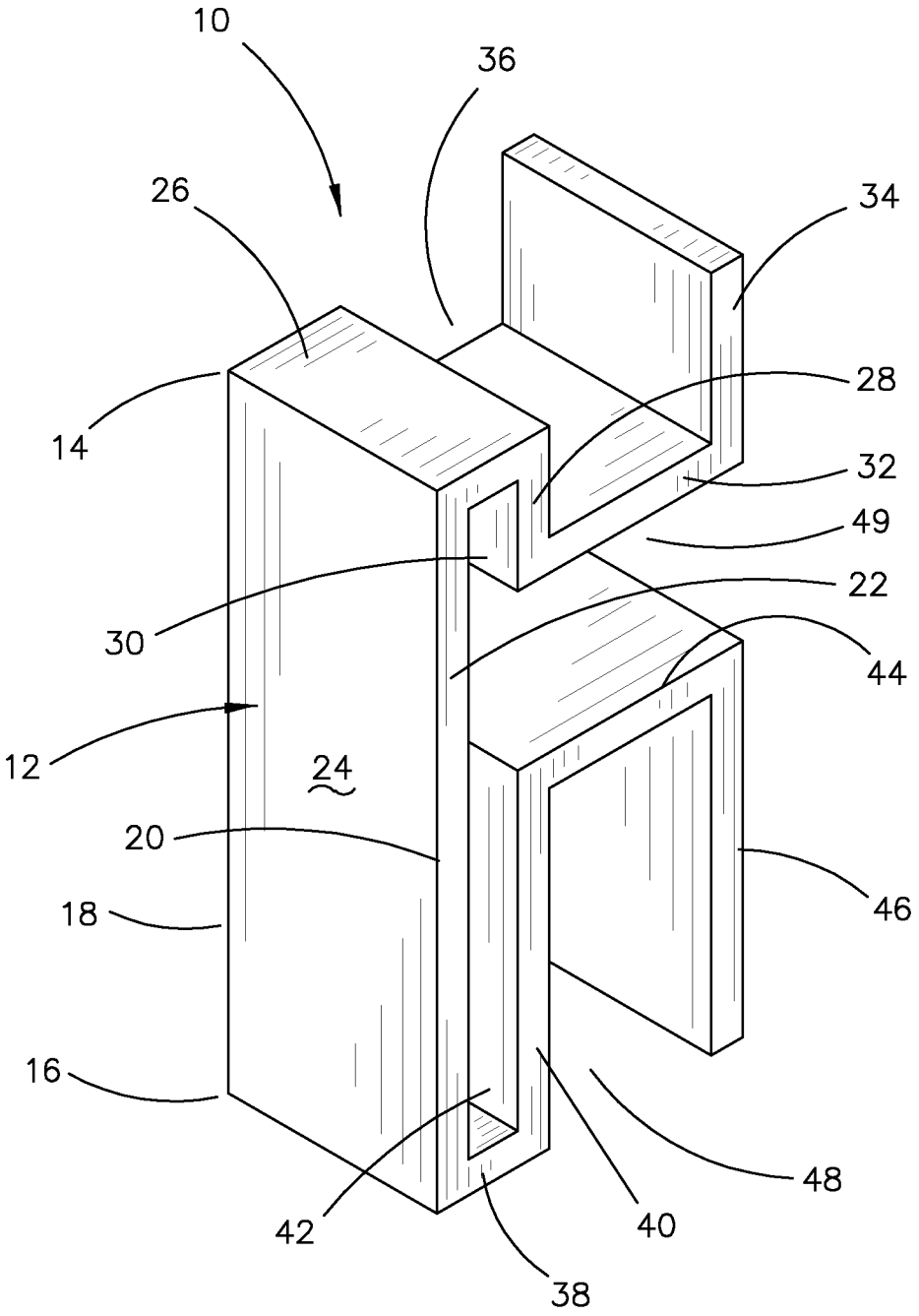
FIG. 1 is a perspective view of the insulation retainer clip of this invention.
Figure 2:
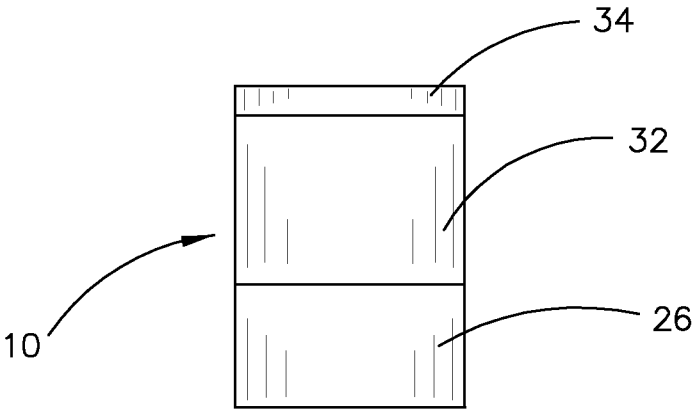
FIG. 2 is a top view of the insulation retainer clip of this invention.
Figure 3:
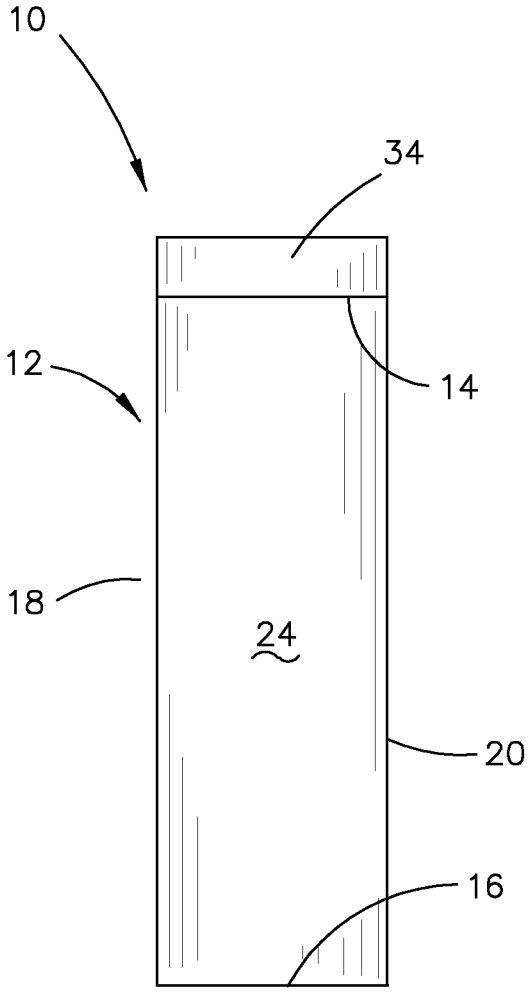
FIG. 3 is a back of the view the insulation retainer clip of this invention.
Figure 4:
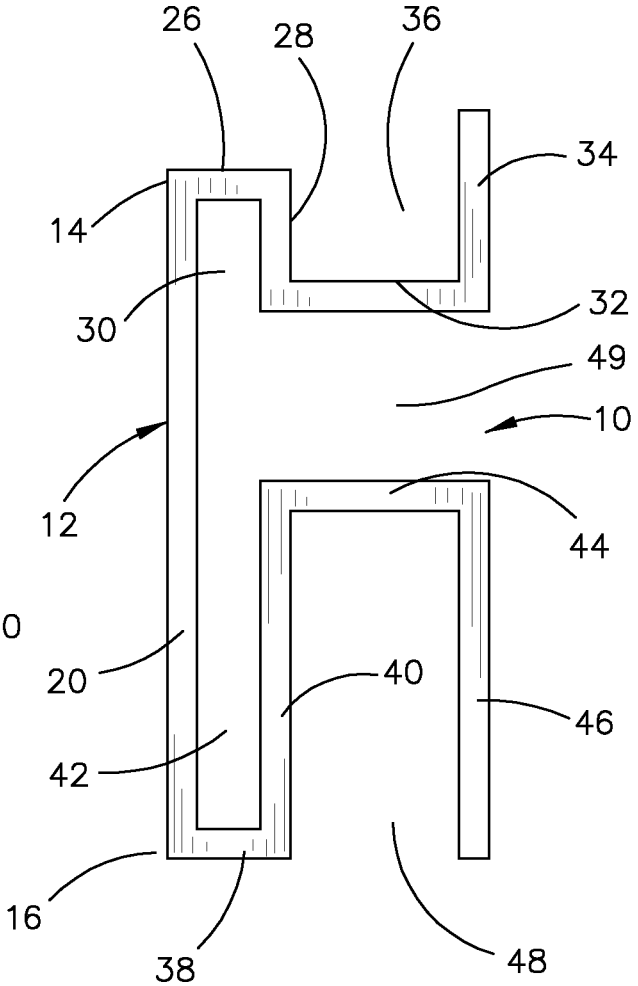
FIG. 4 is a side view of the insulation retainer clip of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The disclosure in U.S. Pat. No. 10,612,574 B1 is incorporated hereon by reference thereto to complete this disclosure if necessary. The numeral 10 refers to the insulation retainer clip of this invention. Clip 10 includes a vertically disposed and rectangular-shaped outer wall 12 having an upper end 14, a lower end 16, a first side 18, a second side 20, an inner side 22 and an outer side 24. A top wall 26 extends horizontally from the upper end 14 of outer wall 12. A vertically disposed wall 28 extends downwardly from the inner end of top wall 26. As seen, wall 28 is spaced inwardly from wall 12 to create a slot 30 therebetween.

A horizontally disposed wall 32 extends inwardly from the lower end of wall 28. A vertically disposed wall 34 extends upwardly from the inner end of wall 32. As seen, wall 34 is spaced inwardly of wall 28 to form a slot 36. As also seen, the upper end of wall 34 is positioned above the top wall 26. A horizontally disposed wall 38 extends inwardly from the lower end of wall 12. A vertically disposed wall 40 extends upwardly from the inner end of wall 38. As seen, wall 40 is spaced inwardly of outer wall 12 to form a slot 42 therebetween. A horizontally disposed wall 44 extends inwardly from the upper end of wall 40. A vertically disposed wall 46 extends downwardly from the inner end of wall 44. As seen, wall 46 is spaced inwardly of wall 40 to form a slot 48 therebetween. As seen, wall 44 is spaced below wall 32 to define a slot 49 therebetween. Clip 10 is preferably comprised of a plastic material or fiberglass material so as to be somewhat flexible.

Figure 5:
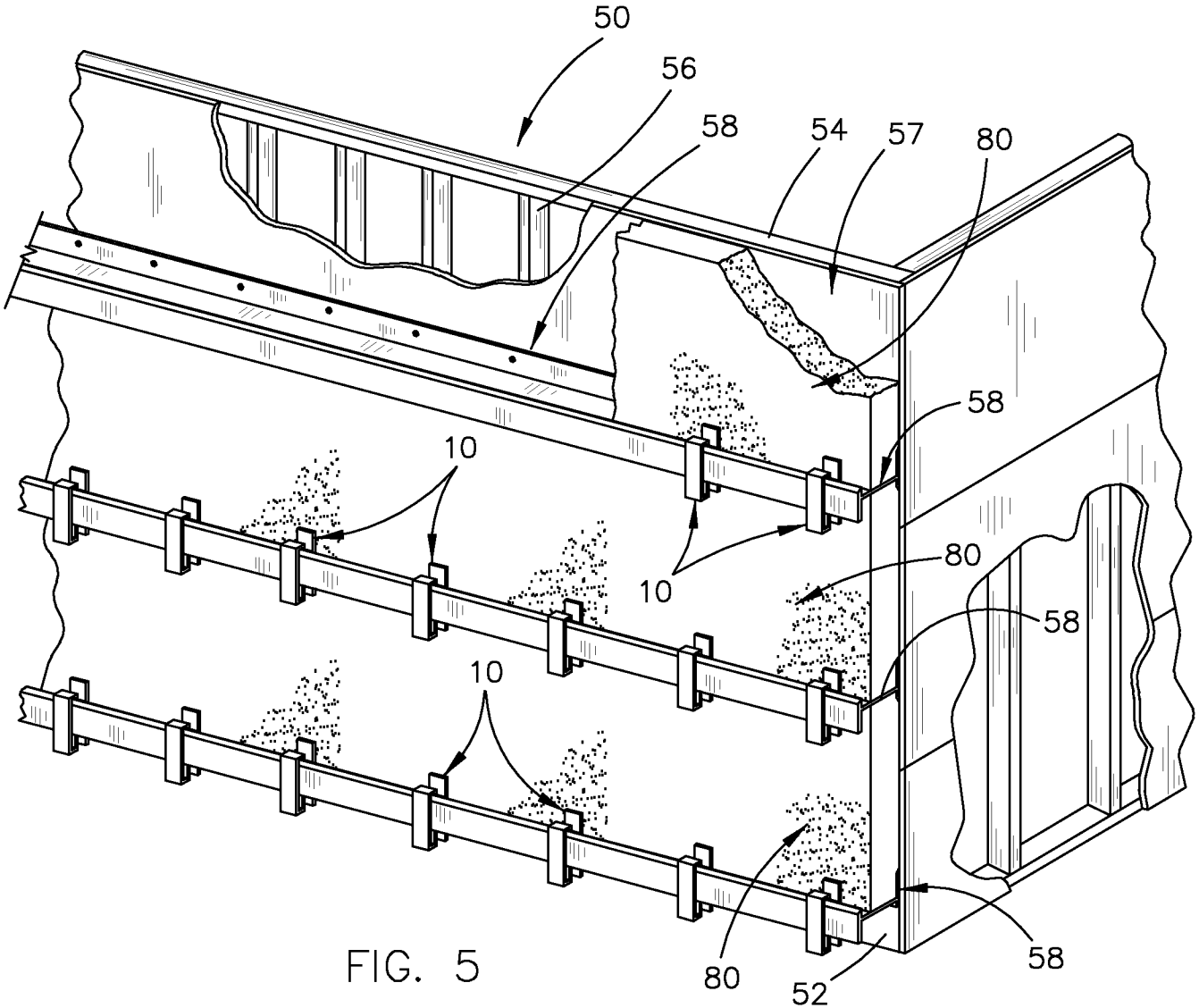
FIG. 5 is a partial perspective view of a wall assembly under construction wherein the insulation retainer clips of this invention are snapped onto horizontally disposed girts to maintain the insulation in place until exterior cladding or the like is secured to the wall assembly.

The numeral 50 refers to a wall assembly under construction as seen in FIG. 5. Wall assembly 50 includes a horizontally disposed bottom plate 52 which is usually a 2"×4" member but could be a 2"×6" member if so desired. Wall assembly 50 also includes a horizontally disposed top plate 54. A plurality of vertically disposed and horizontally spaced-apart studs 56 are secured to plates 52 and 54 and extend therebetween in conventional fashion. Sheathing 57 is secured to the outer side of the studs 56 in conventional fashion. The sheathing 57 may be comprised of plywood, gypsum or other materials. A conventional weather barrier may be secured to the outer side of the sheathing 57.

Figure 6:
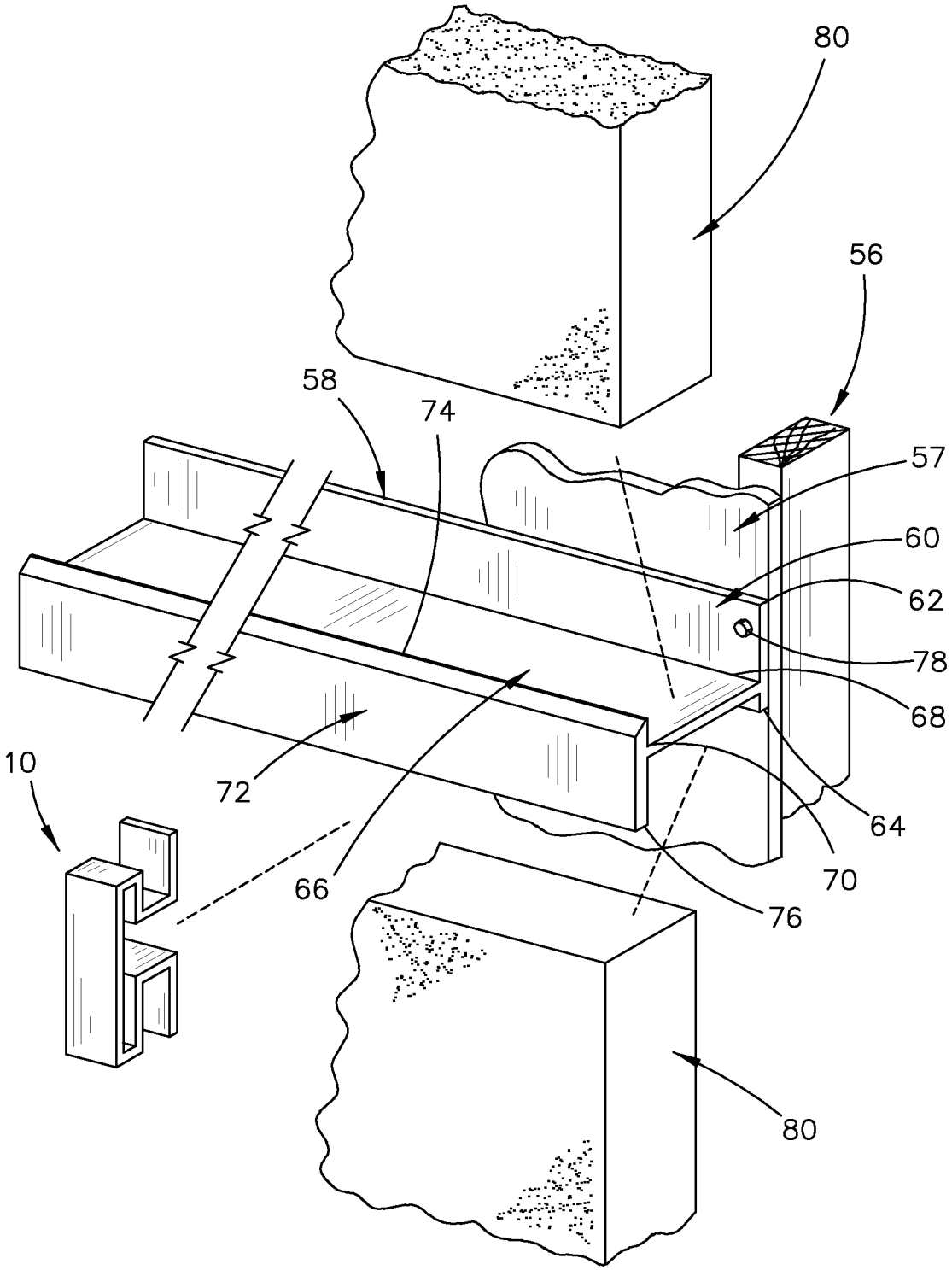
FIG. 6 is a partial exploded perspective view of the insulation retainer clip of this invention, a horizontally disposed girt, insulation and stud.

A plurality of horizontally disposed and elongated girts 58 are secured to the sheathing 57 and studs 56 as set forth hereinbelow. Each of the girts 58 include a vertically disposed inner plate or wall 60 having an upper end 62 and a lower end 64. Each of the girts 58 also have a horizontally disposed wall or plate 66 having an inner end 68 and an outer end 70. The wall 66 extends from wall 60 above the lower end 64 of girt 58 as seen in FIG. 6. Further, each of the girts 58 include a vertical disposed outer wall or plate 72 having a beveled upper end 74 and a lower end 76. As seen, the upper end 74 of girt 58 is positioned above the wall 66. Girt 60 is produced by Strongwell® under the trademark Strongirt® and is comprised of a fiberglass material. Although the girt 60 is described and illustrated, the girt 60 could be a conventional Z-girt as long as the upper end 74 of wall 70 is positioned above wall 66. As seen, the inner wall 60 of girt 58 is secured to the sheathing 57 and studs 56 by screws 78. The numeral 80 refers to sheets of insulation which may be comprised of fiberglass or foam-like material.

The wall assembly 50 is constructed as will now be described. The lowermost girt 58 is positioned at the lower end of the sheathing 57 as seen in FIG. 5. In some cases, the lowermost girt 58 will be replaced by a U-shaped channel such as seen in U.S. Pat. No. 10,612,574. In this particular wall assembly, the U-shaped channel will not be used. The lowermost girt 58 is secured to the sheathing 57 and the studs 56 by screws 78 extending inwardly through openings in wall 60.

The lowermost row of insulation sheets 80 have their lower ends positioned on wall 66. Normally, the upper ends of the lowermost insulation sheets 80 will be in a vertical position before a girt 58 is secured to the sheathing 57 and studs 56 at the upper ends of the insulation sheets 80. A girt 58 is then secured to the sheathing 57 and studs 56 at the upper end of the insulation sheet 80 so that the upper ends of the insulation sheets 80 are received at the underside of wall 66 between the lower end 64 of wall 60 and the lower end of wall 72.

Figure 8:
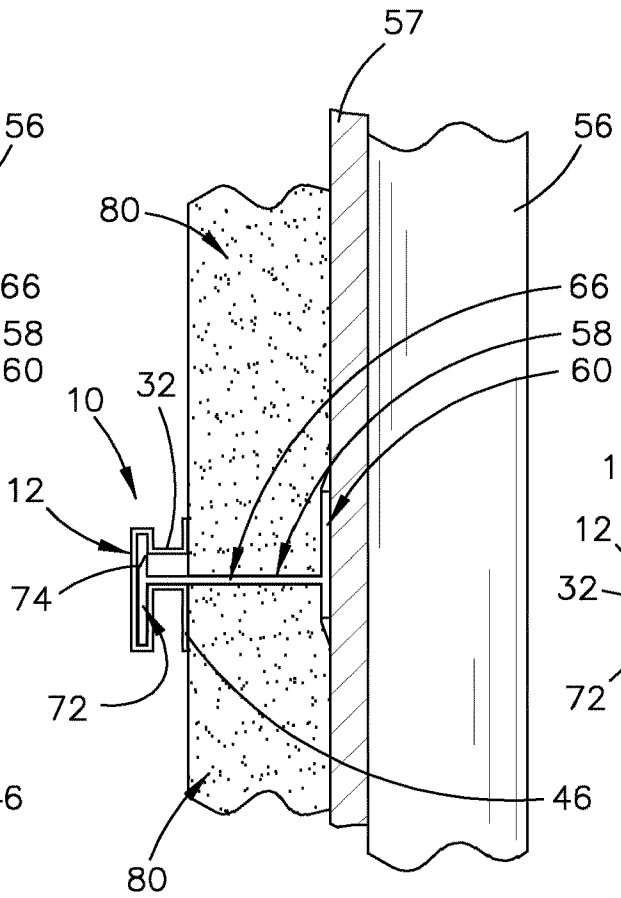
FIG. 8 is a side view similar to FIG. 7 except that the insulation retainer clip of this invention has been initially snapped onto the girt.
Figure 7:
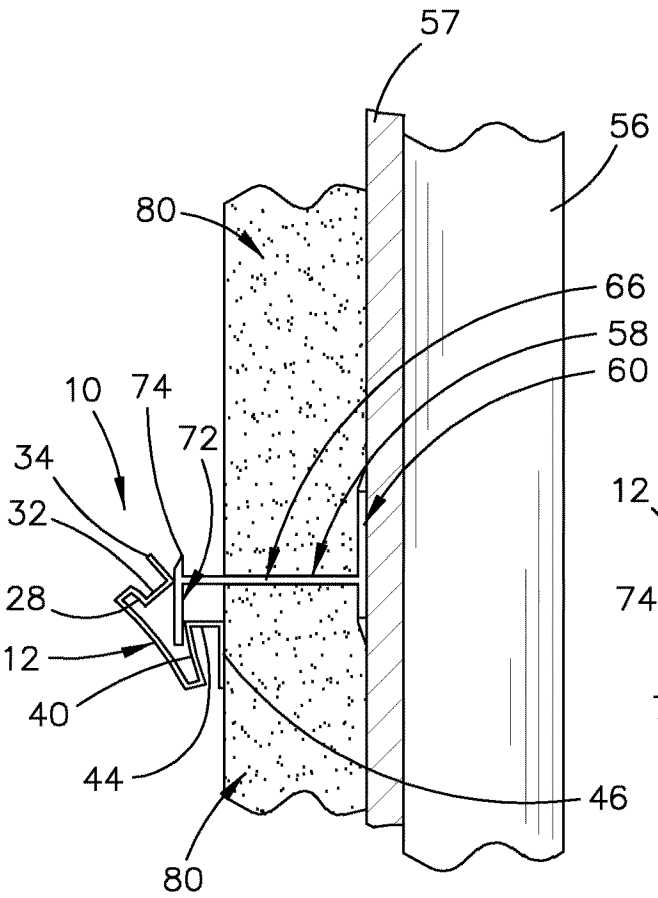
FIG. 7 is a side view of the insulation retainer clip of this invention being secured to a girt.
Figure 11:
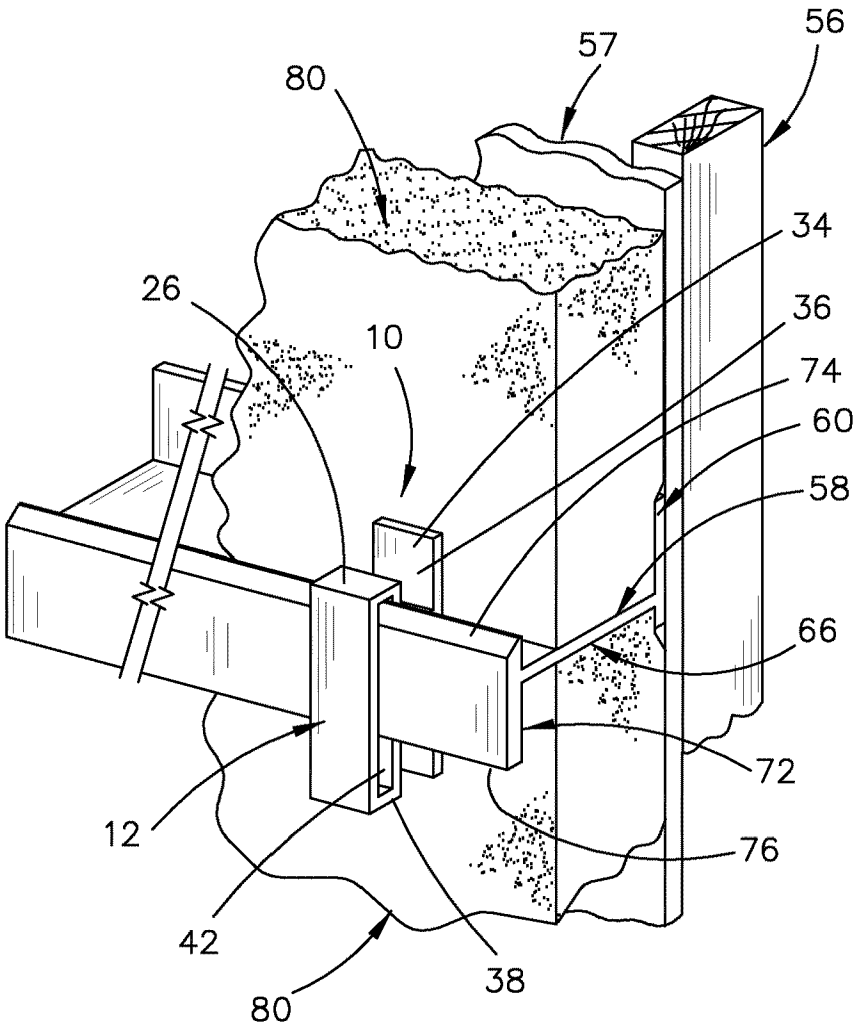
FIG. 11 is a partial perspective view of the insulation retainer clip of this invention being in the position of FIG. 9.
Figure 10:
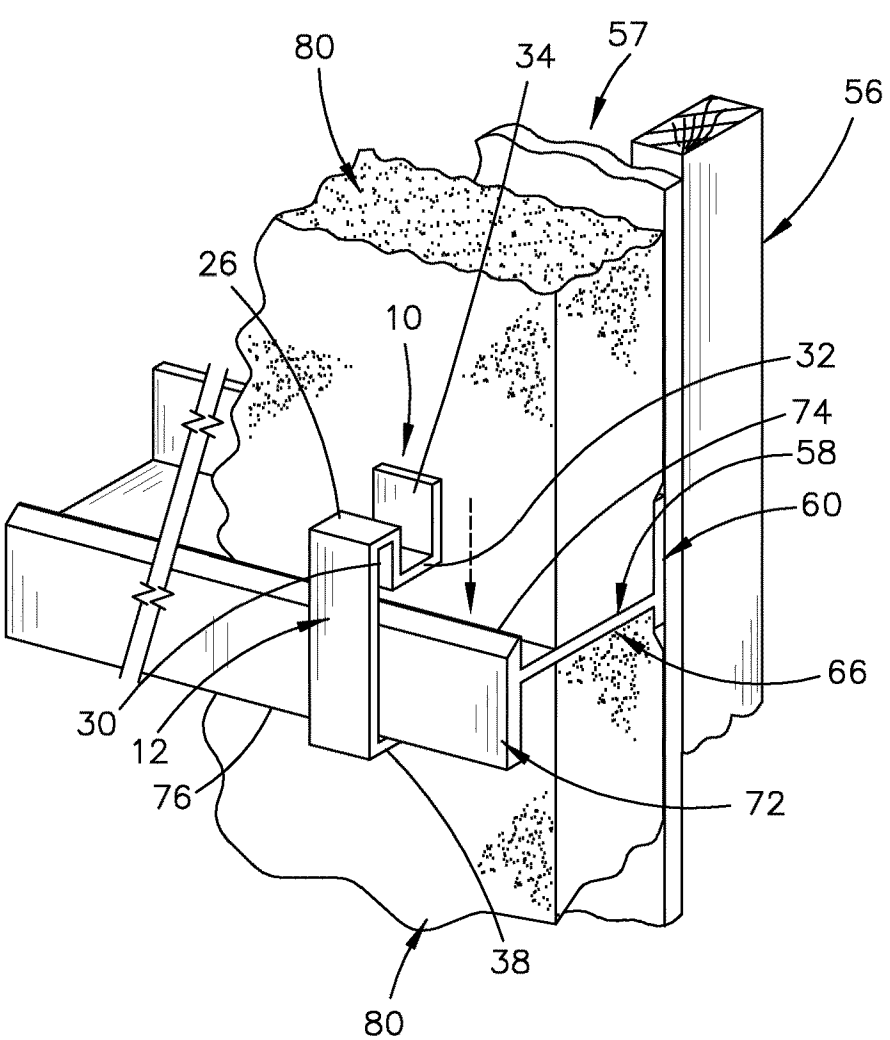
FIG. 10 is a partial perspective view of the insulation retainer clip of this invention being in the position of FIG. 8.

At that time, a plurality of insulation retainer clip 10 are snapped onto the lowermost girt 58 as will now be described. As seen in FIG. 7, the clip 10 is positioned with respect to the girt 58 so that walls 46, 44 and 40 of the clip 10 are positioned between the exterior of insulation 80 and the inner side of wall 72. At that time the intersection of walls 32 and 34 will be in engagement with the outer side of wall 72 near the upper end thereof. Inward pressure is then manually and inwardly applied to the outer upper portion of clip 10 so that the clip 10 is moved from the position of FIG. 7 to the position of FIG. 8. At that time, the wall 34 of the clip 10 will be in engagement with the lower exterior side of the upper insulation member 80. At that same time, the wall 46 of clip 10 will be in engagement with the upper exterior side of the lower insulation member 80. At that time, the clip 10 is moved downwardly from the position of FIG. 8 to the position of FIG. 9.

Figure 9:
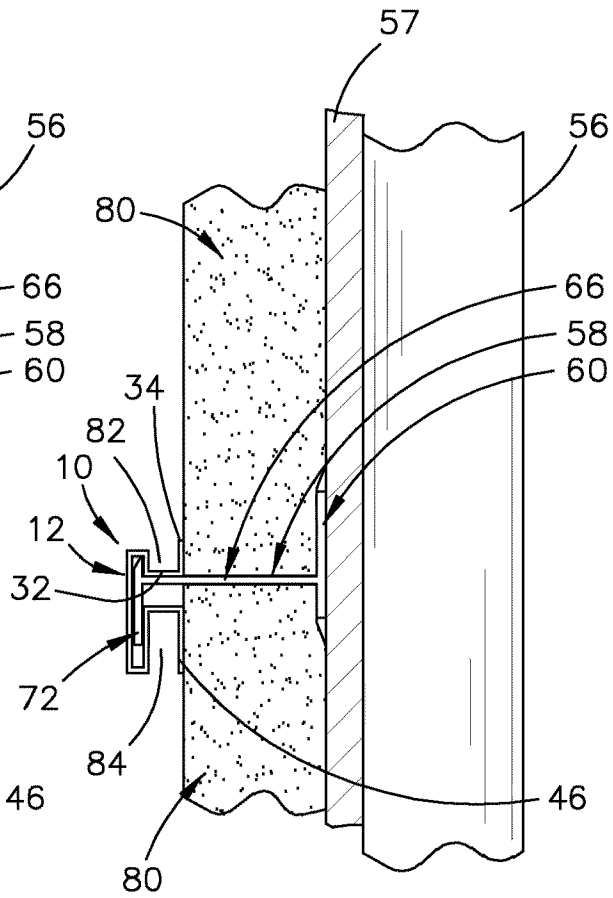
FIG. 9 is a side view similar to FIG. 8 except that the insulation retainer clip of this invention has been lowered onto the girt into the operative position to create a gap at the outer side of the insulation.

In the position of FIG. 9, the clip 10 creates a gap or channel 82 at the outer side of the upper insulation member 80 and creates a gap or channel 84 at the outer side of the lower insulation member 80.

The gaps 82 and 84 are created to allow air and moisture to "dry" the wall if the wall is of the rainscreen type.

Figure 12:
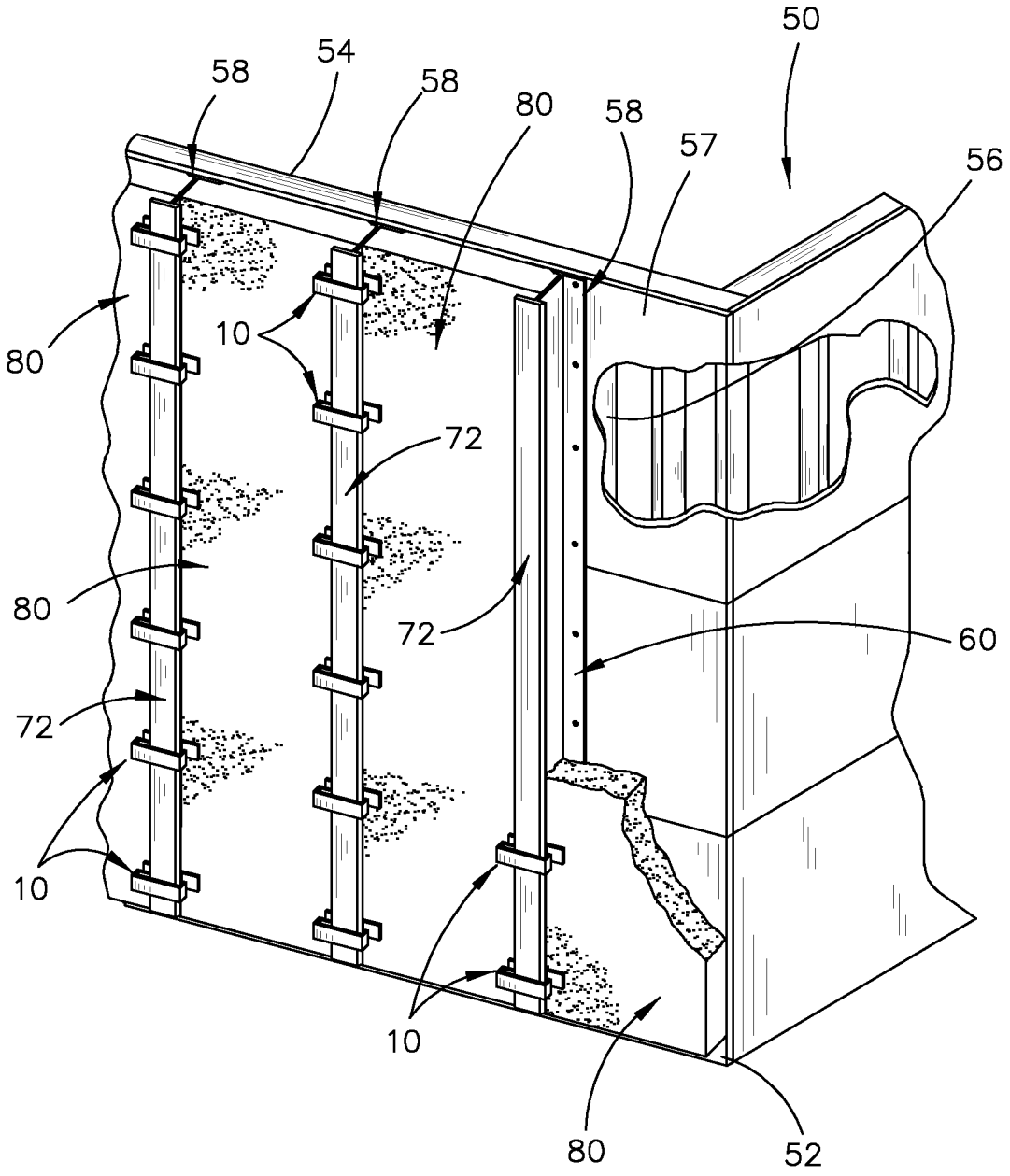
FIG. 12 is a partial perspective view of a wall assembly under construction wherein the girts thereof are vertically disposed and horizontally spaced-apart.
Figure 13:
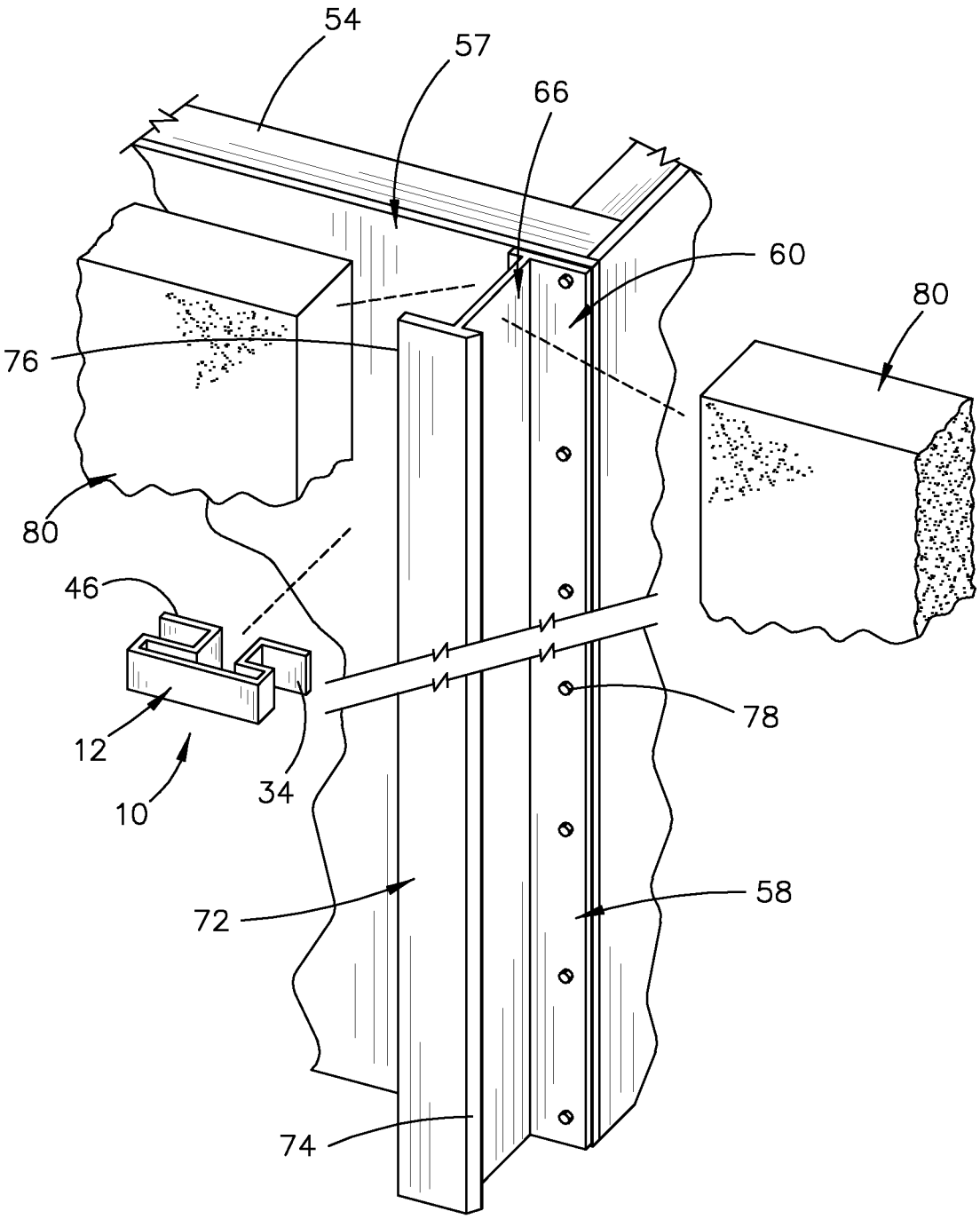
FIG. 13 is a partial perspective view similar to FIG. 6 except that the girts are vertically disposed as in FIG. 12.

The above described process is continued until all of the insulation sheets 80 have been held in place by clips 10 as seen in FIG. 5. If the girts 58 are vertically disposed as seen in FIGS. 12 and 13, the clips 10 are simply rotated 90 degrees for attachment to the vertically disposed girts 58.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. An insulation retainer clip, comprising:

a vertically disposed outer wall having a lower end, an upper end, a first side, a second side, an inner side and an outer side;

a horizontally disposed first wall having an outer end, an inner end, a first side and a second side;

said first wall extending inwardly from said upper end of said outer wall;

a vertically disposed second wall having an upper end, a lower end, a first side and a second side;

said vertically disposed second wall extending downwardly from said inner end of said first wall;

said outer wall and said second wall being spaced-apart to define a first slot therebetween;

a horizontally disposed third wall having an outer end, an inner end, a first side and a second side;

said third wall extending inwardly from said lower end of said second wall;

a vertically disposed fourth wall having a lower end, an upper end, an outer side, an inner side, a first side and a second side;

said fourth wall extending upwardly from said inner end of said third wall;

said second and fourth walls being spaced-apart to define a second slot therebetween;

a horizontally disposed fifth wall having an outer end, an inner end, a first side and a second side;

said fifth wall extending inwardly from said lower end of said outer wall;

a vertically disposed sixth wall having a lower end, an upper end, a first side and a second side;

said sixth wall extending upwardly from said inner end of said fifth wall;

said outer wall and said sixth wall being spaced-apart to define a third slot therebetween;

a horizontally disposed seventh wall having an outer end, an inner end, a first side and a second side;

said seventh wall extending inwardly from said upper end of said sixth wall;

a vertically disposed eighth wall having an upper end, a lower end, a first side and a second side;

said eighth wall extending downwardly from said inner end of said seventh wall;

said sixth and eighth walls being spaced-apart to define a fourth slot therebetween; and said third and seventh walls being spaced-apart to define a fifth slot therebetween.

2. An insulation retainer clip, comprising:

a horizontally extending and vertically disposed outer wall having a first end, a second end, an outer side and an inner side;

a vertically disposed first wall having an inner end and outer end;

said outer end of said first wall being joined to said first end of said outer wall so as to extend inwardly from said first end of said outer wall;

a vertically disposed second wall having a first end and a second end;

said first end of said second wall being joined to said second end of said first wall;

said first and second walls being spaced-apart to define a first slot therebetween;

a vertically disposed third wall having first and second ends;

said first end of said third wall being joined to said second end of said second wall with said third wall extending inwardly from said second end of said second wall;

a vertically disposed fourth wall having first and second ends;

said first end of said fourth wall being joined to said second end of said third wall;

said third and fourth walls being spaced-apart to define a second slot therebetween;

a vertically disposed fifth wall having first and second ends;

said first end of said fifth wall being joined to said second end of said outer wall;

said fifth wall extending inwardly from said second end of said outer wall;

a vertically disposed sixth wall having first and second ends;

said first end of said sixth wall being joined to said second end of said fifth wall;

said sixth wall and said outer wall being spaced-apart to define a third slot therebetween;

a vertically disposed seventh wall having first and second ends;

said first end of said seventh wall being joined to said second end of said sixth wall;

said seventh wall extending inwardly from said second end of said sixth wall;

a vertically disposed eighth wall having first and second ends;

said first end of said eighth wall being joined to said second end of said sixth wall;

said eight wall and said sixth wall being spaced-apart to define a fourth slot therebetween; and said third wall and said seventh wall being spaced-apart to define a fifth slot therebetween.

3. In combination, comprising:

an elongated and horizontally disposed girt for use in a wall under construction;

said girt including:

(a) a vertically disposed inner wall having an upper end, a lower end, an inner side and an outer side;

(b) a horizontally disposed wall having an inner end, an outer end, an upper side and a lower side;

(c) said inner end of said horizontally disposed wall being joined to said inner wall above said lower end of said inner wall so as to extend outwardly therefrom;

(d) a vertically disposed outer wall having an upper end, a lower end, an inner side and an outer side, and (e) said outer end of said horizontally disposed wall being joined to said outer wall below said upper end of said outer wall;

said girt being configured to have insulation positioned on said horizontally disposed wall; and an insulation retainer clip snapped onto said outer end of said horizontally disposed wall of said girt and said outer wall of said girt to maintain the insulation on said horizontally disposed wall and to create a gap between the insulation and said upper end of said outer wall of said girt.

4. The combination of claim 3 wherein said girt is configured to have insulation positioned below said horizontally disposed wall thereof and wherein said insulation retainer clip also maintains the insulation in position below said horizontally disposed plate and creates a gap between the insulation below said horizontally disposed wall and said lower end of said outer wall of said girt.

5. A wall assembly, comprising:

a horizontally disposed bottom plate;

a horizontally disposed top plate;

a plurality of vertically disposed studs secured to said bottom and top plates in a horizontally spaced-apart manner;

each of said studs having an interior side and an exterior side;

sheathing material secured to said exterior sides of said studs;

said sheathing material having an interior side and an exterior side;

a plurality of elongated and horizontally disposed girts secured to said sheathing material in a vertically spaced-apart manner;

said plurality of elongated and horizontally disposed girts defining at least a lower girt, an intermediate girt and an upper girt;

each of said lower intermediate and upper girts including:

(a) a vertically disposed inner wall secured to said sheathing with said inner wall having an upper end, a lower end, an outer side and an inner side;

(b) a horizontally disposed wall having an inner end, an outer end, an upper side and a lower side;

(c) said inner end of said horizontally disposed wall being joined to said inner wall above said lower end of said inner wall and extending outwardly therefrom;

(d) a vertically disposed outer wall having a lower end, an upper end, an outer side and an inner side;

(e) said outer end of said horizontally disposed wall being joined to said outer wall below said upper end of said outer wall;

a plurality of horizontally extending and vertically disposed first insulation sheets having an upper end and a lower end;

said lower ends of said first insulation sheets being positioned on said upper side of said horizontally disposed wall of said lower girt;

said upper ends of said first insulation sheets being received in said intermediate girt below said lower side of said horizontally disposed wall between said lower ends of said inner and outer walls;

a plurality of horizontally extending and vertically disposed second insulation sheets having an upper end and a lower end;

said lower ends of said second insulation sheets being positioned on said upper side of said horizontally disposed wall of said intermediate girt;

said upper ends of said second insulation sheets being received in said upper girt between said lower ends of said inner and outer walls thereof below said horizontally disposed wall of said upper girt;

a plurality of horizontally spaced first insulation retainer clips snapped onto said outer wall of said first girt which are in engagement with the lower ends of said first insulation sheets to maintain said lower ends of said first insulation sheets in position until cladding materials are secured to the wall assembly and to provide a gap between the first insulation sheets and said upper end of its inner wall of the respective girt;

a plurality of horizontally spaced second insulation retainer clips snapped onto said outer wall of said intermediate girt which are in engagement with the upper ends of said first insulation sheets to maintain said upper ends of said first insulation sheets in position until cladding materials are secured to the wall assembly and to provide a gap between the upper ends of the first insulation sheets and said lower end of outer wall of the respective girt; and a plurality of horizontally spaced third insulation clips snapped onto said outer wall of said upper girt which are in engagement with the upper ends of the second insulation sheets to maintain the second insulation sheets in position until cladding materials are secured to the wall assembly and to provide a gap between the upper ends of the second insulation sheets and the lower end of the outer wall of the respective girts.

* * * * *